US009316232B2

(12) United States Patent
Pahlen et al.

(10) Patent No.: US 9,316,232 B2
(45) Date of Patent: Apr. 19, 2016

(54) ROTOR FASTENING ARRANGEMENT

(71) Applicant: KSB Aktiengesellschaft, Frankenthal (DE)

(72) Inventors: Joachim Pahlen, Dirmstein (DE); Jens Ulrich Stahr, Worms (DE)

(73) Assignee: KSB Aktiengesellshaft, Frankenthal (DE)

( * ) Notice: Subject to any disclaimer, the term of this patent is extended or adjusted under 35 U.S.C. 154(b) by 560 days.

(21) Appl. No.: 13/621,492

(22) Filed: Sep. 17, 2012

(65) Prior Publication Data

US 2013/0017074 A1 Jan. 17, 2013

Related U.S. Application Data

(63) Continuation of application No. PCT/EP2011/053937, filed on Mar. 16, 2011.

(30) Foreign Application Priority Data

Mar. 17, 2010 (DE) ..... 10 2010 011 695

(51) Int. Cl.
*F04D 29/053* (2006.01)
*F04D 29/10* (2006.01)
(Continued)

(52) U.S. Cl.
CPC ..... *F04D 29/20* (2013.01); *F04D 29/426* (2013.01); *F04D 29/588* (2013.01)

(58) Field of Classification Search
CPC ... F01D 11/005; F01D 11/003; F01D 25/168; F01D 25/183; F01D 25/186; F04D 17/025; F04D 29/04; F04D 29/0405; F04D 29/043; F04D 29/044; F04D 29/086; F04D 29/053; F04D 29/054; F04D 29/10; F04D 29/106; F04D 29/108; F04D 29/12; F04D 29/122; F04D 29/124; F04D 29/126; F04D 29/128
USPC ..... 415/224 R, 174, 229, 230, 231, 104, 415/105, 106, 107, 109, 111, 124.2, 170.1, 415/174.3; 416/104, 107, 109, 111, 124.2, 416/170.1, 174.3, 229, 230, 231, 244 R, 416/244 A, 244 B, 245 R, 246, 174
See application file for complete search history.

(56) References Cited

U.S. PATENT DOCUMENTS 1,978,814 A * 10/1934 Myers ..... 403/6
2,010,525 A * 8/1935 McHugh ..... 403/7
(Continued)

FOREIGN PATENT DOCUMENTS

DE 101 01 165 A1 7/2002
DE 10 2007 044 646 A1 3/2009
(Continued)

OTHER PUBLICATIONS

International Search Report with English translation dated Jun. 28, 2011 (seven (7) pages).
(Continued)

*Primary Examiner* — Dwayne J White
*Assistant Examiner* — Joshua R Beebe
(74) *Attorney, Agent, or Firm* — Crowell & Moring LLP

(57) ABSTRACT

A rotor fastening arrangement, particularly for connecting a drive shaft and a rotor hub of a centrifugal pump assembly, having a fitting surface and at least one contact surface at the drive-shaft end. Respective ends of the drive-shaft (3) and the rotor hub (1*a*) are each provided with an internally threaded central hole. A fitting surface and at least one contact surface also are formed on the rotor hub (1*a*). An intermediate shaft (2) is provided between drive shaft (3) and rotor hub (1*a*) in order to connect the rotor hub and drive shaft. A fitting surface and at least one contact surface are formed respectively at both ends of the intermediate shaft (2) for alignment; at least one connecting member is provided for connecting the intermediate shaft (2) to the drive shaft (3) and the rotor hub (1*a*), and a seal is arranged on the intermediate shaft.

11 Claims, 2 Drawing Sheets

(51) Int. Cl.

| | |
|---|---|
| ***F04D 29/20*** | (2006.01) |
| ***F04D 29/42*** | (2006.01) |
| ***F04D 29/58*** | (2006.01) |

(56) References Cited

U.S. PATENT DOCUMENTS

| | | | | | |
|---|---|---|---|---|---|
| 2,960,939 | A | * | 11/1960 | Buschhorn et al. | 415/140 |
| 3,191,976 | A | * | 6/1965 | Arnts et al. | 403/355 |
| 3,711,218 | A | * | 1/1973 | Kennel et al. | 415/131 |
| 3,740,162 | A | * | 6/1973 | Tuomaala | 415/98 |
| 3,874,824 | A | * | 4/1975 | Cronstedt et al. | 417/406 |
| 3,924,978 | A | * | 12/1975 | Loyd et al. | 418/60 |
| 4,278,396 | A | * | 7/1981 | Vander Horst | 415/63 |
| 4,523,900 | A | * | 6/1985 | Frey | 417/365 |
| 4,810,918 | A | * | 3/1989 | Kachuk | 310/90 |
| 5,785,491 | A | * | 7/1998 | Ozawa et al. | 415/70 |
| 6,398,521 | B1 | * | 6/2002 | Yorulmazoglu | 417/360 |
| 2006/0222537 | A1 | * | 10/2006 | Kilty | 417/423.6 |
| 2007/0280825 | A1 | * | 12/2007 | Chen | 415/199.4 |
| 2010/0034650 | A1 | * | 2/2010 | Hassert et al. | 415/229 |
| 2010/0189567 | A1 | * | 7/2010 | Jaeger et al. | 416/244 R |

FOREIGN PATENT DOCUMENTS

| | | | |
|---|---|---|---|
| DE | 10 2007 054 195 | A1 | 5/2009 |
| FR | 2 288 888 | A2 | 5/1976 |
| GB | 829977 | A | 3/1960 |
| JP | 55-62896 | U | 4/1980 |
| JP | 59-34099 | U | 3/1984 |

OTHER PUBLICATIONS

English translation of Japanese Office Action dated Dec. 3, 2013 {Three (3) pages}.

* cited by examiner

ROTOR FASTENING ARRANGEMENT

CROSS REFERENCE TO RELATED APPLICATIONS

This application is a continuation of international patent application no. PCT/EP2011/053937, filed Mar. 16, 2011 designating the United States of America, and published in German on Sep. 22, 2011 as WO 2011/113849, the entire disclosure of which is incorporated herein by reference. Priority is claimed based on Federal Republic of Germany patent application no. DE 10 2010 011 695.5, filed Mar. 17, 2010, the entire disclosure of which is likewise incorporated herein by reference.

BACKGROUND OF THE INVENTION

This invention relates to a rotor fastening arrangement, in particular for the connection between a drive shaft and a rotor hub of a centrifugal pump assembly, wherein a fitting surface and at least one contact surface are formed on a drive shaft end, wherein the drive shaft end is provided with a central bore having an internal thread, wherein a fitting surface and at least one contact surface are formed on the rotor hub and wherein the rotor hub is provided with a central bore having an internal thread.

German patent publication no. DE 10 2007 044 646 A1 describes a rotor fastening arrangement on a centrifugal pump assembly which is comprised of a centrifugal pump and a drive. It is shown how the connection between a drive shaft and a rotor hub is established by a threaded screw. In this case the internal thread of the drive shaft and of the rotor hub is formed in the same direction and continuously. The device shown makes possible a secure connection between drive and rotor. What is not described in the document is the shaft seal between the rotor represented and the drive motor. Depending on the field of application, in some cases very high demands are placed on this seal. In a typical case, the centrifugal pump assembly may be sealed by a single axial face seal. In some cases, however, it is necessary to provide a double seal for safety reasons. In this case two seals are mounted serially along the shaft, creating an additional space requirement for the second seal. The rotor fastening arrangement from DE 10 2007 044 646 A1 must be re-dimensioned for these cases.

SUMMARY OF THE INVENTION

It is the object of the invention to provide a rotor fastening arrangement which makes possible both the use of a single axial face seal and the use of a double seal without impairing the radial and axial run-out properties of the rotor.

This object is achieved by providing a rotor fastening arrangement in which an intermediate shaft for connecting the rotor hub to the drive shaft is provided between the drive shaft and the rotor hub, a fitting surface and at least one contact surface being formed in each case at both ends of the intermediate shaft for rectilinear flush alignment of the drive shaft, the intermediate shaft and the rotor hub, and at least one connector being provided for connecting the intermediate shaft to the drive shaft and to the rotor hub. According to the invention a seal is arranged on the intermediate shaft. The two shafts are thereby connected non-rotatably to one another. Furthermore, the additional installation space required for a further sealing element is made available. It is advantageous in this case that the fastening of the rotor hub to the drive shaft is effected by the fitting surfaces in a centered manner, simply and within the prescribed tolerances. In addition, the existing pump, which has a single axial face seal, can be supplemented by an additional seal.

In a further, advantageous embodiment an axial face seal is provided on the intermediate shaft. It is advantageous in this case that additional securing of the pump against leakage is effected.

In a further, advantageous embodiment a collar which prevents slippage of the axial face seal is provided on the intermediate shaft. It is thereby achieved that the axial face seal is fixed in a definite location, improving the security of the sealing.

In a further embodiment, the intermediate shaft has a continuous through-bore containing, for example, a continuous thread, the intermediate shaft being screwed to the rotor hub and to the drive shaft by a threaded rod or a threaded pin. It is advantageous in this case that production of the individual parts is greatly simplified while at the same time the axial and radial run-out properties of the rotor are improved.

In an alternative embodiment, the intermediate shaft has a blind bore at its first end and a threaded stub at its second end. This intermediate shaft can be fitted between existing shaft ends as an extension.

In a further embodiment a sealing element is provided between the intermediate shaft and the rotor hub. In this case it is advantageous that penetration of fluid into the joint between rotor hub and intermediate shaft is prevented.

According to the invention a kit is provided for the rotor fastening arrangement, all appropriate intermediate shafts being made available for a fixed number of drive shafts and rotor hubs. By using the intermediate shafts, pumps and drives can be combined within the kit. In addition to providing the possibility of further sealing, the intermediate shaft makes available the benefit of an adapter for different connections on the drive and pump sides.

The invention further includes a casing part for receiving the intermediate shaft described. This intermediate casing is connectable in a pressure-tight manner to the drive casing on the drive side and to the pump casing on the pump side. This arrangement gives rise to a closed chamber located between the first seal on the pump side and the second seal on the drive side. This chamber is filled with a barrier fluid. If leakage occurs at the pump-side seal, it can be taken up by the barrier fluid.

In a further embodiment, a cooling unit is provided in the sealed chamber. In this case it is advantageous that the axial face seals can be maintained at a constant temperature, enabling their service life to be prolonged.

Further embodiments result from combining those previously described and therefore are not explained further here.

BRIEF DESCRIPTION OF THE DRAWINGS

The invention will be described in further detail hereinafter with reference to illustrative embodiments shown in the accompanying drawing figures, in which.

DETAILED DESCRIPTION OF ILLUSTRATIVE EMBODIMENTS

Figure 1:
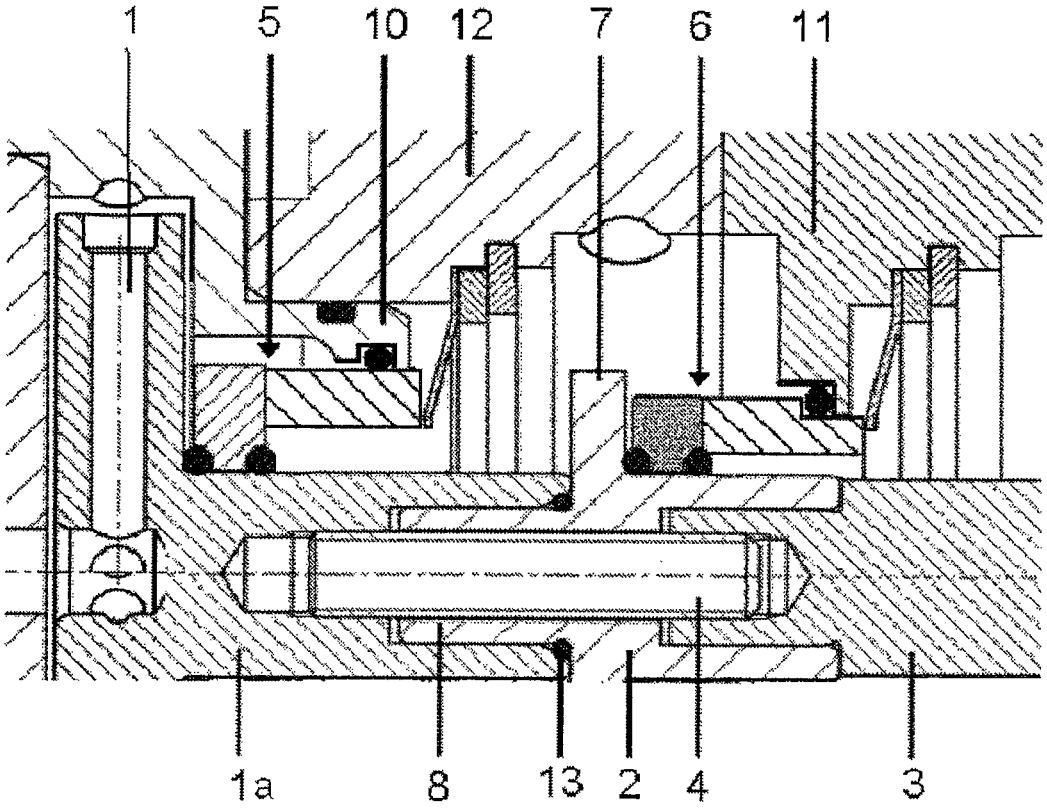
FIG. 1 shows a first embodiment of a rotor fastening arrangement according to the invention.

A first embodiment of the rotor fastening arrangement according to the invention is represented in FIG. 1. A drive shaft 3 has a central threaded bore for receiving a threaded pin 4. An intermediate shaft 2 provided with a through-bore 8 is mounted with a centered fit on the drive shaft 3. A rotor hub 1*a* has a central threaded bore and is mounted with a centered fit on the intermediate shaft 2. The threaded pin 4 screwed in the rotor hub 1*a* and in the drive shaft 3 braces the intermediate shaft 2 by frictional engagement. An axial face seal 5 on the pump side bears against the rotor 1 and seals the rotor hub 1*a* from a pump casing 10. An axial face seal 6 on the drive side bears against a collar 7 of the intermediate shaft 2 and seals the intermediate shaft 2 from a drive casing 11. The axial face seal parts which bear against the rotor hub 1*a* and the collar 7 of the intermediate shaft are connected non-rotatably to the rotor hub 1*a* and to the intermediate shaft 2. An intermediate casing 12 connects the pump casing 10 to the drive casing 11 in a pressure-tight manner and forms a sealed chamber between the two axial face seals 5, 6. This chamber serves to receive a barrier fluid and can take up leakages or block them from the pump chamber. A sealing element 13 prevents the barrier fluid from entering the gap of the intermediate shaft 2.

Figure 2:
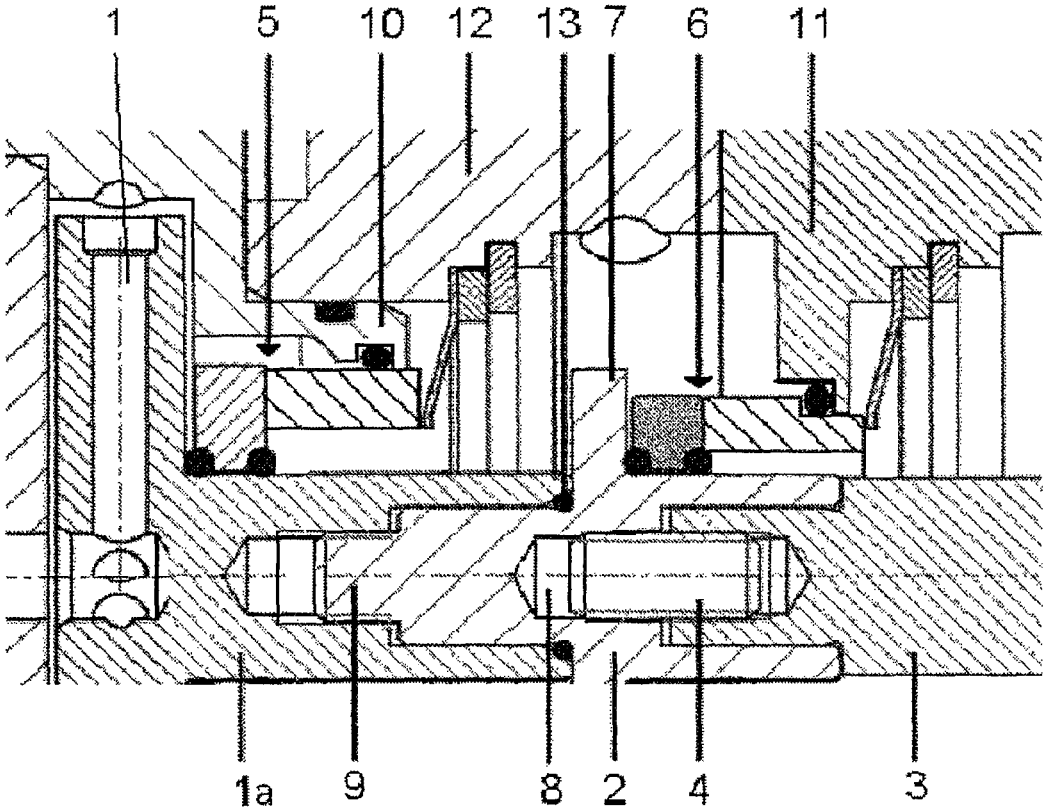
FIG. 2 shows a second embodiment of the rotor fastening arrangement according to the invention.

A further embodiment of the rotor fastening arrangement according to the invention is represented in FIG. 2. A drive shaft 3 has a central threaded bore for receiving the threaded pin 4. An intermediate shaft 2 provided with a central threaded bore is mounted with a centered fit on the drive shaft 3 and is screw-fixed thereto by frictional engagement. The rotor hub 1*a* has a central threaded bore and is mounted with a centered fit on the intermediate shaft 2. The screw-fixing by frictional engagement of intermediate shaft 2 and rotor hub 1*a* is effected by a threaded stub 9 located on the intermediate shaft 2.

In order to exclude the possibility of a double fit when assembling intermediate shaft 2 and rotor hub 1*a*, a suitable material pairing or coating on the fitting surfaces is selected. Any tendency to fret is thereby prevented.

As in the previously described illustrative embodiment, the axial face seal 6 on the drive side is mounted between the collar 7 and the drive casing 11.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A rotor fastening arrangement for connecting a drive shaft to a rotor hub, wherein a fitting surface and at least one contact surface are formed on a drive shaft end;

said end of the drive shaft is provided with a central bore having an internal thread;

a fitting surface and at least one contact surface are formed on the rotor hub;

the rotor hub is provided with a central bore having an internal thread;

an intermediate shaft is provided between the drive shaft and the rotor hub for connecting the rotor hub to the drive shaft;

a fitting surface and at least one contact surface are formed on each respective end of the intermediate shaft;

at least one connector is provided for connecting the intermediate shaft to the drive shaft and to the rotor hub, a drive-side axial face seal is arranged on the intermediate shaft, and a collar provided on the intermediate shaft biases the drive-side axial face seal against a drive casing containing the drive shaft.

2. The rotor fastening arrangement as claimed in claim 1, wherein the intermediate shaft has an axial through-bore.

3. The rotor fastening arrangement as claimed in claim 2, wherein the through-bore is threaded, and the intermediate shaft is fastened to the drive shaft and to the rotor hub by a threaded pin.

4. The rotor fastening arrangement as claimed in claim 1, wherein the intermediate shaft has a bore at a first axial end and a threaded stub at a second axial end.

5. The rotor fastening arrangement as claimed in claim 4, wherein said bore is a blind bore.

6. The rotor fastening arrangement as claimed in claim 1, further comprising a sealing element provided between the intermediate shaft and the rotor hub.

7. The rotor fastening arrangement as claimed in claim 1, wherein the rotor hub is the hub of a centrifugal pump rotor, and the drive shaft is the drive shaft of a pump motor assembled to the centrifugal pump for driving the pump.

8. A kit for rotor fastening arrangement as claimed in claim 1, said kit comprising a plurality of different intermediate shafts, wherein the different intermediate shafts are each provided with different drive-side and/or pump-side connection configurations.

9. An intermediate casing for receiving a rotor fastening arrangement as claimed in claim 1, wherein said intermediate casing is connected in a pressure-tight manner to a drive casing on the drive side and to a pump casing on the pump side so as to enclose a chamber for the intermediate shaft located between the pump casing and the drive casing.

10. The intermediate casing as claimed in claim 9, further comprising a cooling unit provided in the enclosed chamber.

11. The intermediate casing as claimed in claim 9, wherein the enclosed chamber is filled with a barrier fluid.

* * * * *